US008928237B2

(12) United States Patent
Otake et al.

(10) Patent No.: US 8,928,237 B2
(45) Date of Patent: Jan. 6, 2015

(54) LUMINAIRE

(71) Applicant: Toshiba Lighting & Technology Corporation, Kanagawa (JP)

(72) Inventors: Hirokazu Otake, Kanagawa (JP); Fumihiko Nagasaki, Kanagawa (JP); Takuro Hiramatsu, Kanagawa (JP); Katsuya Ooto, Tokyo (JP)

(73) Assignee: Toshiba Lighting & Technology Corporation, Kanagawa (JP)

( * ) Notice: Subject to any disclaimer, the term of this patent is extended or adjusted under 35 U.S.C. 154(b) by 35 days.

(21) Appl. No.: 13/730,031

(22) Filed: Dec. 28, 2012

(65) Prior Publication Data

US 2014/0077713 A1 Mar. 20, 2014

(30) Foreign Application Priority Data

Sep. 14, 2012 (JP) ..... 2012-203275

(51) Int. Cl.

| | |
|---|---|
| ***H05B 37/02*** | (2006.01) |
| ***H05B 39/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 37/02* (2013.01); *H05B 33/0818* (2013.01)

USPC ..... 315/209 R; 315/186; 315/193; 315/224; 315/291

(58) Field of Classification Search

None

See application file for complete search history.

(56) References Cited

U.S. PATENT DOCUMENTS

| | | | | |
|---|---|---|---|---|
| 2007/0024213 | A1 | 2/2007 | Shteynberg et al. | |
| 2008/0224629 | A1 | 9/2008 | Melanson | |
| 2012/0104958 | A1 | 5/2012 | Zudrell-Koch et al. | |
| 2012/0112648 | A1* | 5/2012 | Hariharan | 315/186 |
| 2012/0187857 | A1* | 7/2012 | Ulmann et al. | 315/224 |
| 2012/0229041 | A1* | 9/2012 | Saes et al. | 315/200 R |

FOREIGN PATENT DOCUMENTS

| | | |
|---|---|---|
| EP | 2 164 300 A1 | 3/2010 |
| JP | 2011-210446 | 10/2011 |

OTHER PUBLICATIONS

European Search Report dated Feb. 26, 2014 for Application No. 12 19 7149.

* cited by examiner

*Primary Examiner* — Anh Tran

(74) *Attorney, Agent, or Firm* — Patterson & Sheridan LLP

(57) ABSTRACT

A luminaire according to one embodiment includes a DC power supply circuit, a switching power supply, and a lighting load. The DC power supply circuit converts an AC voltage controlled in phase to a DC voltage. The switching power supply is connected to the DC power supply circuit, and is controlled so that an input current becomes a constant current. The lighting load is connected as a load circuit of the switching power supply.

18 Claims, 6 Drawing Sheets

LUMINAIRE

CROSS-REFERENCE TO RELATED APPLICATIONS

This application is based upon and claims the benefit of priority from the prior Japanese Patent Application No. 2012-203275, filed on Sep. 14, 2012; the entire contents of which are incorporated herein by reference.

FIELD

Embodiments described herein relate generally to a luminaire.

BACKGROUND

In recent years, replacement of lighting sources from incandescent lamps or fluorescent lamps to energy saving and long life light sources such as Light-emitting diodes (LED) in luminaires is in progress. Also, for example, new lighting sources such as Electro-Luminescence (EL) or Organic light-emitting diode (OLED) are also developed.

On the other hand, as a high-luminance lighting source, there are luminaires using, for example, a halogen lamp. In such luminaires, dimming is achieved by performing phase control of a commercial power supply using a dimmer configured so as to control a phase in which a triac is turned ON. There is a case where a voltage of the commercial power supply is lowered by using a magnetic transformer or an electronic transformer. The dimmer and the electronic transformer require a minimum load current for a stable operation. Therefore, it is preferable that the lighting source such as LED may be illuminated by an AC voltage lowered by the electronic transformer or the like, and may be dimmed by the dimmer.

DETAILED DESCRIPTION

Figure 1:
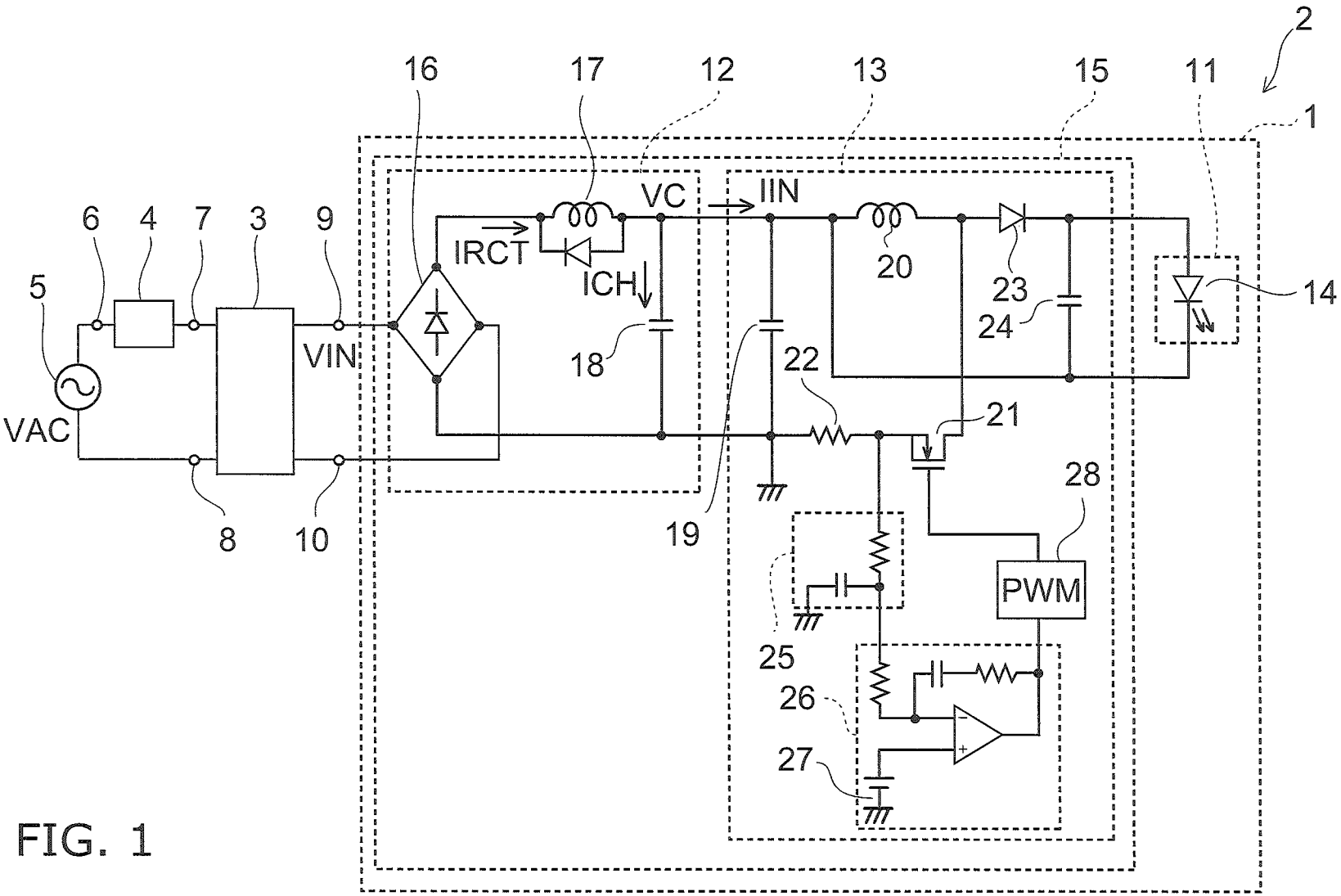
FIG. 1 illustrates a circuit diagram of a luminaire according to a first embodiment.

In general, according to one embodiment, a luminaire includes a DC power supply circuit, a switching power supply, and a lighting load. The DC power supply circuit converts an AC voltage controlled in phase to a DC voltage. The switching power supply is connected to the DC power supply circuit, and is controlled so that an input current becomes a constant current. The lighting load is connected as a load circuit of the switching power supply.

Referring now to the drawings, exemplary embodiments will be described in detail. In this specification of the application and respective drawings, the same components as those described relating to already presented drawings are designated by the same reference numerals and detailed description will be omitted as needed.

First Embodiment

FIG. 1 illustrates a circuit diagram of a luminaire according to a first embodiment.

A luminaire 1 according to the first embodiment includes a lighting load 11, a DC power supply circuit 12, and a switching power supply 13. The luminaire 1 illuminates by receiving a supply of a phase-controlled AC voltage VIN. FIG. 1 exemplifies the AC voltage VIN generated from an AC power supply 5 via a transformer 3 for lowering the voltage and a dimmer 4. Also, the DC power supply circuit 12 and the switching power supply 13 constitute a lighting power supply 15.

The lighting load 11 includes a lighting source 14 such as an LED, connected as a load circuit of the switching power supply 13, and is turned ON by receiving a supply of power from the switching power supply 13. The lighting load 11 may be modulated by changing the power to be supplied to the lighting load 11. For example, the lighting load 11 may be modulated by changing at least one of an output voltage and an output current of the switching power supply 13.

The DC power supply circuit 12 converts the AC voltage VIN controlled in phase and input to a pair of input terminals 9 and 10 into a DC voltage VC. The DC power supply circuit 12 includes a rectifying circuit 16, a choke coil 17 for preventing noise, and a smoothing capacitor 18. A diode for voltage clamping and a resistor for damping are connected to the choke coil 17 in parallel as needed.

The rectifying circuit 16 is, for example, a diode bridge, and the DC power supply circuit 12 rectifies the AC voltage VIN controlled in phase and input to the pair of input terminals 9 and 10 and outputs a pulsed voltage. The smoothing capacitor 18 is connected to an output terminal of the rectifying circuit 16, smoothen the pulsed voltage output from the rectifying circuit 16 (in this embodiment, a case where the pulsed voltage is not smoothen completely, but smoothen to an extent which leaves a pulsing constituent is exemplified), and outputs the DC voltage VC.

In the luminaire 1, a configuration in which the DC power supply circuit 12 includes the rectifying circuit 16, the choke coil 17, and the smoothing capacitor 18 is exemplified. However, the DC power supply circuit 12 only has to be capable of inputting the AC voltage VIN and outputting the DC voltage VC, and may have other configurations.

The switching power supply 13 is connected to the DC power supply circuit 12, converts power supplied from the DC power supply circuit 12, and turns ON the lighting load 11. The switching power supply 13 includes a capacitor 19, an inductor 20, a switching element 21, a current detection resistor 22, a rectification element 23, an output capacitor 24, a low-pass filter 25, an error amplifying circuit 26, and a PWM circuit 28. All or part of the low-pass filter 25, the error amplifying circuit 26, and the PWM circuit 28 may be integrated as integrated circuit (IC).

The capacitor 19 is connected to the smoothing capacitor 18 in parallel, eliminates high-frequency noise, and smoothen the DC voltage VC (the extent of the smoothing is the same as described above). The capacitor 19 may be included in the smoothing capacitor 18, or may include the smoothing capacitor 18. An operating power is supplied to the error amplifying circuit 26, the PWM circuit 28, or an IC thereof obtained by integrating these circuits by power of at least one of the smoothing capacitor 18 and the capacitor 19.

The inductor 20, the switching element 21, and the current detection resistor 22 are connected in series to both ends of the smoothing capacitor 18 and the capacitor 19. The switching element 21 is, for example, a FET, and if the switching element 21 is turned ON, an input current IIN flows, and if the switching element 21 is turned OFF, the input current IIN is blocked. A voltage proportional to the input current IIN is detected by the current detection resistor 22.

The rectification element 23 is, for example, a diode. The output capacitor 24 and the lighting load 11 are connected to both ends of the inductor 20 via the rectification element 23, and when the switching element 21 is turned OFF, the output capacitor 24 is charged by accumulated energy of the inductor 20 via the rectification element 23. When the voltage across the output capacitor 24 reach or exceed a predetermined value, the lighting load 11 is turned ON. Here, the predetermined value is a voltage at which the lighting load 11 starts illumination, and for example, when the lighting source 14 is an LED, it is a forward voltage.

In other words, the switching power supply 13 inputs the input current IIN and accumulates energy irrespective of a load current of the lighting load 11, and forms an indirect type converter configured to supply the accumulated energy to the lighting load 11.

The low-pass filter 25 includes, for example, a resistor and a capacitor, smoothens a detected value detected by the current detection resistor 22, and outputs the smoothened value as an average value of the input current IIN.

The error amplifying circuit 26 includes a reference voltage generating circuit 27, compares the average value of the input current IIN and a reference voltage, amplifies a differential voltage, and outputs the amplified voltage as an error signal.

The PWM circuit 28 generates a control signal by, for example, PWM (Pulse Width Modulation) on the basis of the error signal output from the error amplifying circuit 26, and controls a gate (control terminal) to the switching element 21. For example, when the average value of the input current IIN is higher than the reference voltage, the PWM circuit 28 generates the control signal so that a duty ratio, which is a proportion of ON period of the switching element 21, becomes small. When the average value of the input current IIN is lower than the reference voltage, the PWM circuit 28 generates the control signal so that the duty ratio is increased.

Therefore, the switching power supply 13 performs negative feedback control on the switching element 21 on the basis of the detected value detected by the current detection resistor 22, and controls the average value of the input current IIN to be a predetermined constant current.

The transformer 3 is connected between terminals 7 and 8 and the input terminals 9 and 10 of the luminaire 1, converts the AC voltage at the terminals 7 and 8, and outputs the converted voltage to the DC power supply circuit 12. The transformer 3 is an electronic transformer configured to convert the frequency of voltage to a frequency different from the frequency of the AC voltage of the terminals 7 and 8, for example, a frequency higher than that of the AC voltage of the terminals 7 and 8 and output the converted frequency to the DC power supply circuit 12. The transformer 3 lowers the AC voltage of the terminals 7 and 8 and outputs the lowered AC voltage to the DC power supply circuit 12.

Figure 2:
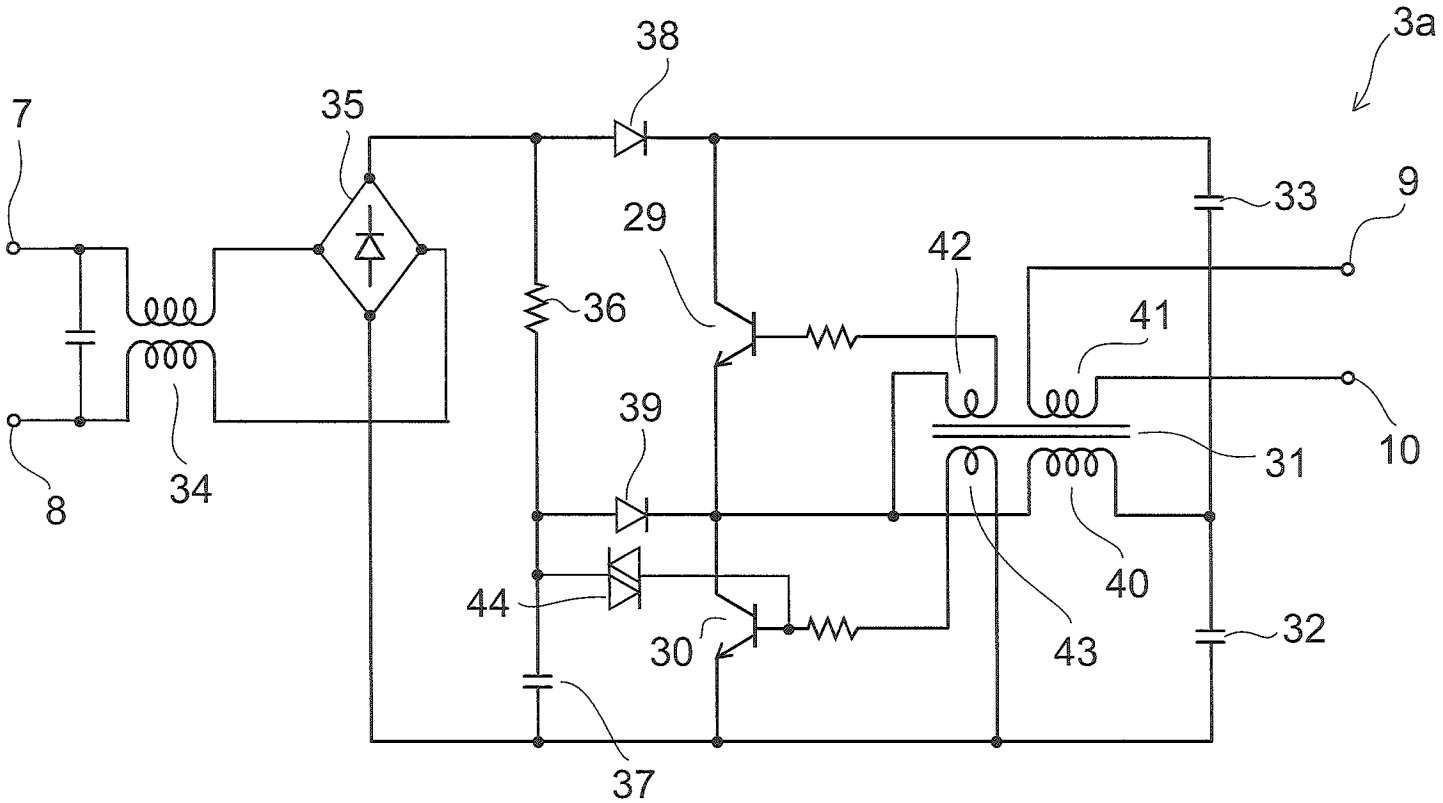
FIG. 2 illustrates a circuit diagram of an electronic transformer.

FIG. 2 illustrates a circuit diagram exemplifying the electronic transformer.

As illustrated in FIG. 2, an electronic transformer 3*a* includes a high-side switch 29, a low-side switch 30, a transformer 31, resonant capacitors 32 and 33, a choke coil 34 for preventing noise, a rectifying circuit 35, a resistor 36, a capacitor 37, diodes 38 and 39, and a DIAC 44 or the like.

The rectifying circuit 35 is connected to the terminals 7 and 8 via the choke coil 34, and rectifies the AC voltage to be input to the terminals 7 and 8.

The high-side switch 29 and the low-side switch 30 are, for example, an NPN transistor, and are connected to an output of the rectifying circuit 35 in series via the diode 38. The resonant capacitors 32 and 33 are connected to the output of the rectifying circuit 35 in series via the diode 38.

The transformer 31 includes winding wires 40, 41, 42, and 43. The winding wire 40 is connected between a connecting point between the high-side switch 29 and the low-side switch 30 and a connecting point between the resonant capacitors 32 and 33. The winding wire 41 is an output winding wire, and is connected to the input terminals 9 and 10 of the luminaire 1. The winding wire 42 is a feedback winding wire, and is connected to a base (control terminal) of the high-side switch 29 via a protecting resistor. The winding wire 43 is a feedback winding wire, and is connected to a base (control terminal) of the low-side switch 30 via a protecting resistor. The phases of voltages to be induced in the winding wires 42 and 43 are opposite from each other, and the winding wires 42 and 43 are connected at polarities supplied to the respective bases of the high-side switch 29 and the low-side switch 30.

The resistor 36 and the capacitor 37 are connected to the output of the rectifying circuit 35 in series. The diode 39 is connected between a connecting point between the resistor 36 and the capacitor 37, and the connecting point between the high-side switch 29 and the low-side switch 30.

The DIAC 44 is connected between the connecting point between the resistor 36 and the capacitor 37, and a base (control terminal) of the low-side switch 30. The DIAC 44 supplies a pulse to the base of the low-side switch 30 when power is supplied, turns the low-side switch 300N, and activates the electronic transformer 3*a*.

The electronic transformer 3*a* is a self-exciting current resonant inverter, and the high-side switch 29 and the low-side switch 30 constitute a half bridge circuit. For example, when the DC power supply circuit 12 of the luminaire 1 has a full-wave rectifier circuit, voltages having polarities opposite from each other are induced in the winding wire 42 and the winding wire 43 by a load current flowing in the winding wire 41. Consequently, the high-side switch 29 and the low-side switch 30 are turned ON alternately, and a resonance current flows through the winding wire 40 and the resonant capacitors 32 and 33.

In contrast, when the load current flowing in the winding wire 41 is decreased, the voltages induced in the winding wires 42 and 43 are decreased, so that the high-side switch 29 and the low-side switch 30 cannot be switched between ON and OFF any longer.

The electronic transformer 3*a* includes a minimum load current for a stable operation.

Referring back to FIG. 1 again, the dimmer 4 is connected between the AC power supply 5 and the transformer 3, and is connected to one of power supply lines between the terminals 6 and 7. The AC power supply 5 is, for example, a commercial power supply. In FIG. 1, the dimmer 4 is exemplified to have a configuration inserted in one of the pair of power supply lines in series. However, other configurations are also applicable.

Figure 3:
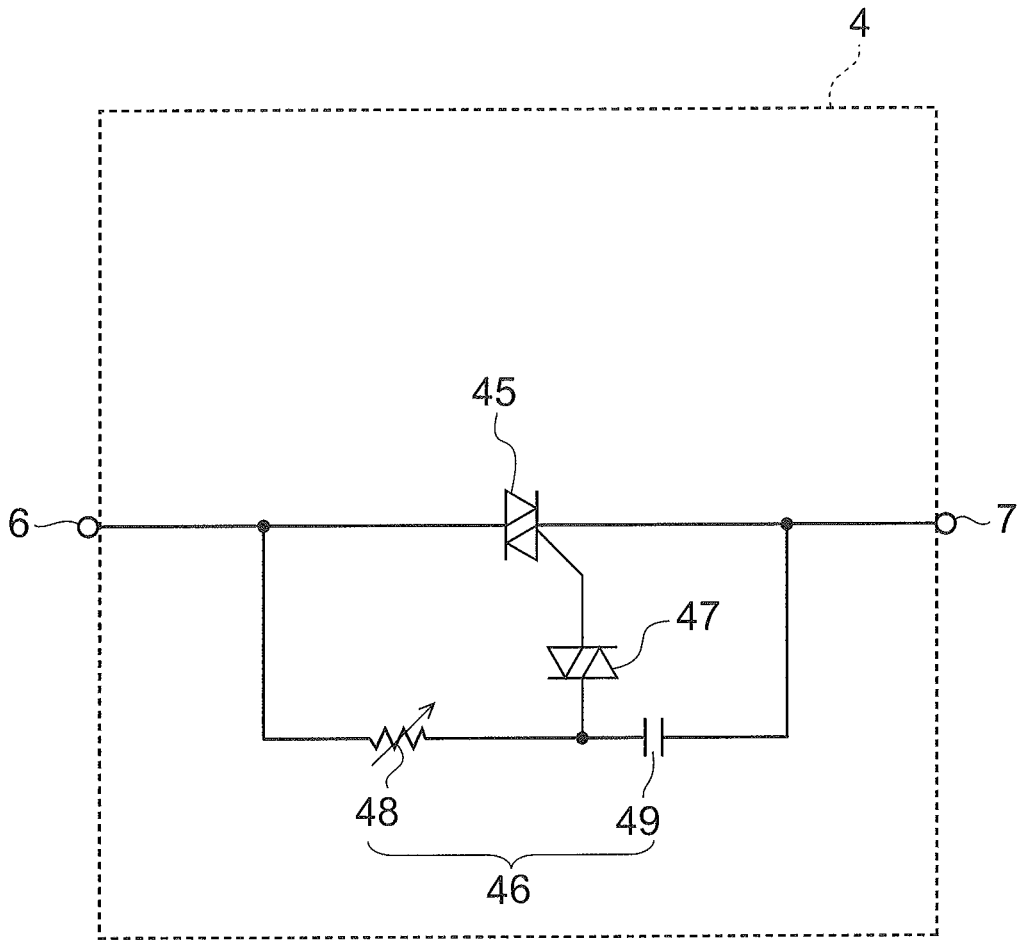
FIG. 3 illustrates a circuit diagram of a dimmer.

FIG. 3 is a circuit diagram illustrating the dimmer.

The dimmer 4 includes a triac 45 inserted into the power line between the terminals 6 and 7 in series, a phase circuit 46 connected in parallel to the triac 45, and a DIAC 47 connected between a gate of the triac 45 and the phase circuit 46.

The triac 45 is normally OFF and is turned ON when a pulse signal is input to the gate. The triac 45 allows a current to flow in both directions when an alternating power supply voltage VAC has a positive polarity and a negative polarity.

The phase circuit 46 includes a variable resistor 48 and a timing capacitor 49, and generates a voltage between both ends of the timing capacitor 49 delayed in phase. When a resistance value of the variable resistor 48 is varied, a time constant varies and a delay time varies.

The DIAC 47 generates the pulse voltage when the voltage to be charged in the timing capacitor 49 of the phase circuit 46 exceeds a certain value, and turns ON the triac 45.

The timing when the triac 45 is turned ON may be adjusted by controlling the timing when the DIAC 47 generates pulses by varying the time constant of the phase circuit 46. Therefore, the dimmer 4 is capable of controlling a conducting phase of a half cycle of the AC voltage.

In contrast, in order to maintain the triac 45 in the ON state, it is necessary to cause a current more than a holding current to flow, and the dimmer 4 holds a minimum load current for a stable dimming.

Figure 4A:
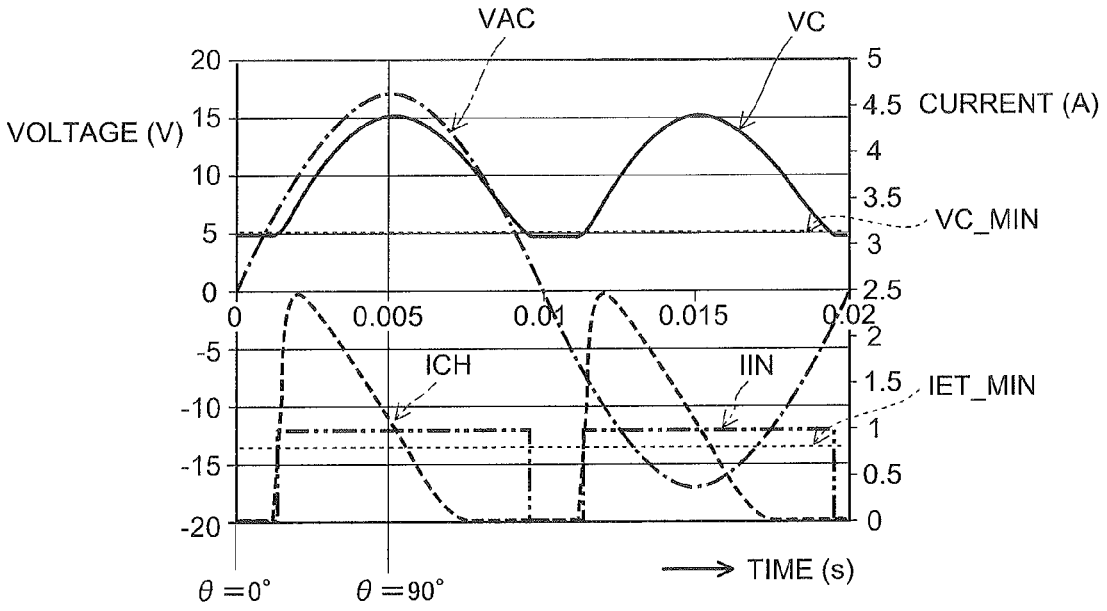
FIGS. 4A and 4B illustrate waveform diagrams exemplifying a principal signal of the luminaire.
Figure 4B:
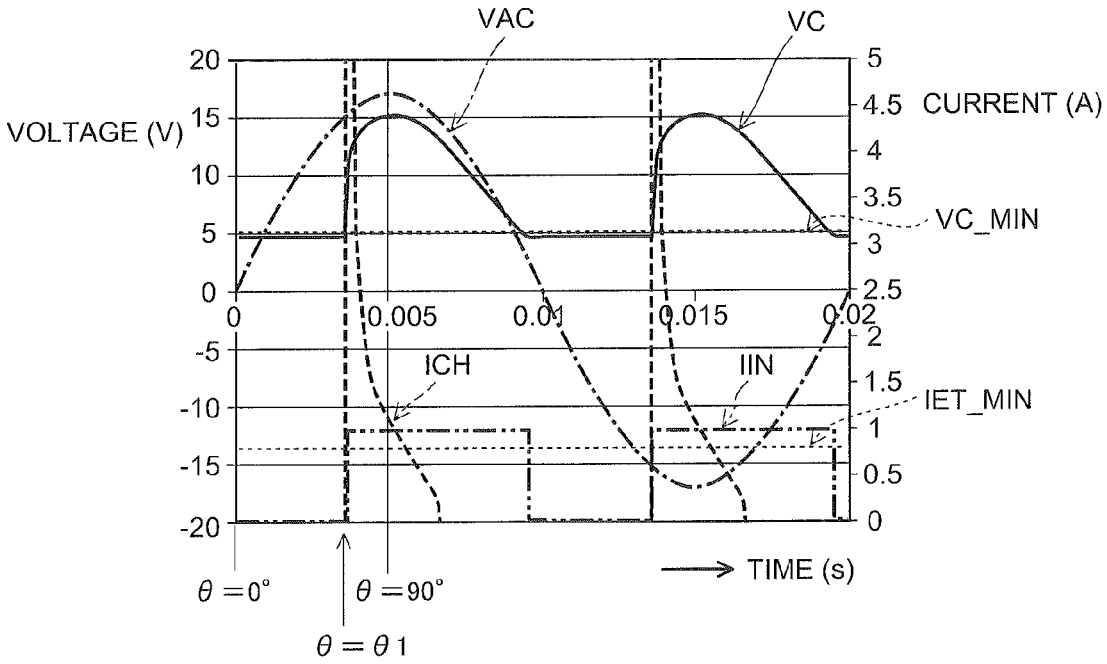

FIGS. 4A and 4B illustrate waveform diagrams exemplifying principal signals of the luminaire. FIG. 4A is a case where the dimmer is not provided, and FIG. 4B is a case where the dimmer is provided.

For reference, FIGS. 4A and 4B are waveform diagrams where the transformer 3 is not provided, and illustrate the power supply voltage VAC of the AC power supply 5, the DC voltage VC of the DC power supply circuit 12, a charging current ICH of the smoothing capacitor 18 of the DC power supply circuit 12, and the input current IIN of the switching power supply 13. In contrast, the minimum load current of the transformer 3, for example, an electronic transformer load current value at which the electronic transformer 3*a* starts a self-exciting oscillation is expressed as IET_MIN.

First of all, an operation of the luminaire 1 when the power supply is turned ON will be described.

When the power supply is turned ON, the DC voltage VC of the DC power supply circuit 12, which is the voltage across the smoothing capacitor 18 is increased from zero. At this time, when a minimum voltage (operable lower limit voltage) which allows the switching power supply 13 to operate is expressed as VC_MIN, the switching power supply 13 is not operated until the DC voltage VC reaches or exceeds the operable lower limit voltage VC_MIN.

Corresponding to the increase in the power supply voltage VAC, the DC voltage VC reaches or exceeds the operable lower limit voltage VC_MIN, the switching power supply 13 starts operation.

When the DC voltage VC is smaller than the operable lower limit voltage VC_MIN, the switching power supply 13 is not operated, and the input current IIN does not flow. The DC voltage VC changes corresponding to the change of an instantaneous value of the power supply voltage VAC. However, since an electrical charge of the output capacitor 24 remains in the switching power supply 13, the DC voltage VC is not lowered to a value lower than values around the operable lower limit voltage VC_MIN.

Subsequently, the operation of the luminaire 1 in a stationary state will be described.

As described above, when the power supply voltage VAC crosses zero at time 0 (s) and increases, the switching power supply 13 is not operated until the DC voltage VC reaches or exceeds the operable lower limit voltage VC_MIN, and the input current IIN and the charging current ICH do not flow (FIG. 4A).

When the DC voltage VC reaches or exceeds the operable lower limit voltage VC_MIN in association with the increase in the power supply voltage VAC, the input current IIN of the switching power supply 13 flows and the charging current ICH flows to the smoothing capacitor 18 slightly earlier than the input current IIN (FIG. 4A). An input current IRCT of the DC power supply circuit 12 becomes a synthetic current (IRCT=IIN+ICH) composed of the input current IIN of the switching power supply 13 and the charging current ICH of the smoothing capacitor 18.

As described above, the switching power supply 13 is controlled so that the average value of the input current IIN becomes a predetermined constant current, the input current IIN is constant with respect to the change of the DC voltage VC (FIG. 4A). Consequently, when the power supply voltage VAC increases, the proportion of the charging current ICH of the smoothing capacitor 18 in the input current IRCT (ICH/IRCT) is characterized by decreasing.

As illustrated in FIG. 4B, when an trigger phase of the dimmer 4 is set to angle θ1, the DC voltage VC is increased abruptly and reaches or exceeds the operable lower limit voltage VC_MIN when a phase θ of the power supply voltage VAC becomes the trigger phase θ1. A peak value of the charging current ICH of the smoothing capacitor 18 increases as the trigger phase θ1 gets close to 90°, and a peak value of the input current IRCT of the DC power supply circuit 12 also increases (FIG. 4B). However, the input current IIN of the switching power supply 13 is controlled to a constant current value without depending on the value of the DC voltage VC. Consequently, in the vicinity of a peak value at which the power supply voltage VAC becomes a maximum value or a minimum value, the proportion of the charging current ICH of the smoothing capacitor 18 in the input current IRCT (ICH/IRCT) is characterized by decreasing as the trigger phase θ1 gets close to 90°.

Comparative Example

Next, a comparative example will be described.

Figure 5:
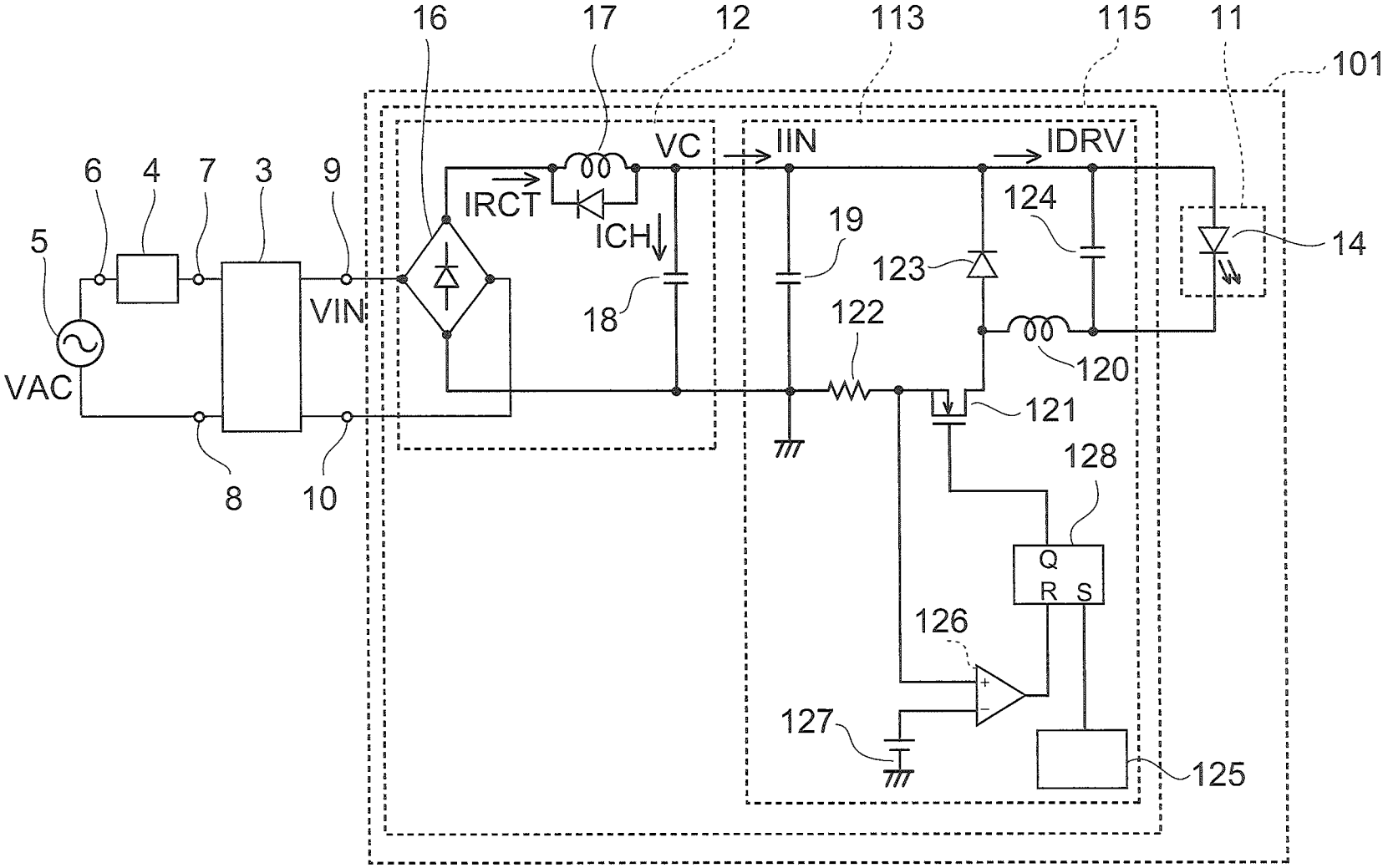
FIG. 5 illustrates a circuit diagram exemplifying a comparative example.

FIG. 5 illustrates a circuit diagram exemplifying the comparative example.

A comparative example 101 is different from the luminaire 1 in the first embodiment in configuration of the switching power supply 13, and is a luminaire provided with a switching power supply 113 instead of the switching power supply 13. The configurations of the comparative example other than those described above are the same as those of the luminaire 1.

The switching power supply 113 controls so that the power to be supplied to the lighting load 11 becomes constant. In order to do so, the switching power supply 113 includes the capacitor 19, an inductor 120, a switching element 121, a current detection resistor 122, a rectification element 123, an output capacitor 124, a set-pulse generating circuit 125, a comparator circuit 126, a reference voltage generating circuit 127, and an RS latch circuit 128.

The capacitor 19 is connected in parallel to the smoothing capacitor 18 of the DC power supply circuit 12.

The rectification element 123, the switching element 121, and the current detection resistor 122 are connected in series to both ends of the capacitor 19. The rectification element 123 is, for example, a diode, and the switching element 121 is, for example, a FET. The output capacitor 124 and the inductor 120 are connected in series to both ends of the rectification element 123, and the lighting load 11 is connected to both ends of the output capacitor 124.

During a period when the switching element 121 is ON, the input current TIN, that is, a driving current IDRV of the lighting load 11 flows. In a period when the switching element 121 is OFF, the input current IIN is blocked and the driving current IDRV flows through the inductor 120 and the rectification element 123. A voltage proportional to the input current IIN is detected by the current detection resistor 122. In other words, a peak value of a current rising in a triangle wave form via the inductor 120 is detected.

The comparator circuit 126 resets the RS latch circuit 128 when the peak value of the input current IIN detected by the current detection resistor 122 is larger than a reference voltage of the reference voltage generating circuit 127. The set-pulse generating circuit 125 sets the RS latch circuit 128 at a constant frequency. The RS latch circuit 128 controls a gate of the switching element 121, and turns the switching element 1210N or OFF. Therefore, according to an output of the comparator circuit 126, an ON period (on duty) of the switching element 121 is controlled.

In this manner, the switching power supply 113 controls so that the current to be supplied to the lighting load 11 becomes constant by controlling the input current IIN, that is, the peak value of the driving current IDRV to be constant. For example, when applied to a load having a highly constant voltage characteristic such as an LED, an operation at the constant power is achieved as a result. Consequently, an average value of the input current IIN and the driving current IDRV is characterized by decreasing when the DC voltage VC is increased, and increasing when the DC voltage VC is degreased. An input characteristic of the switching power supply 113 is a negative resistance characteristic.

Figure 6A:
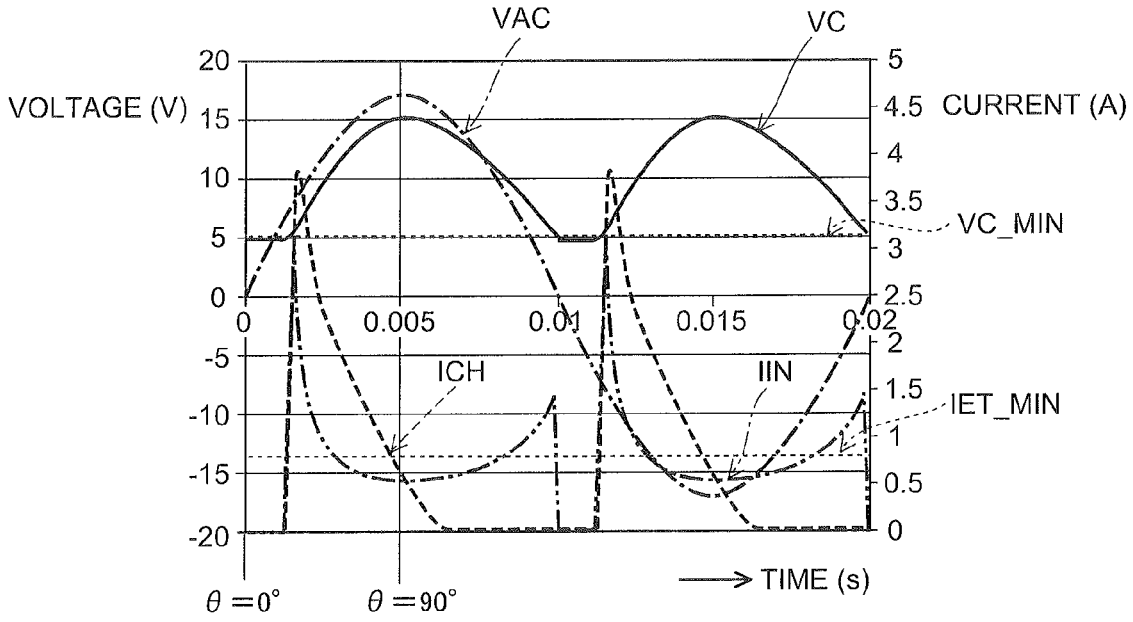
FIGS. 6A and 6B illustrate waveform diagrams exemplifying a principal signal of the comparative example.
Figure 6B:
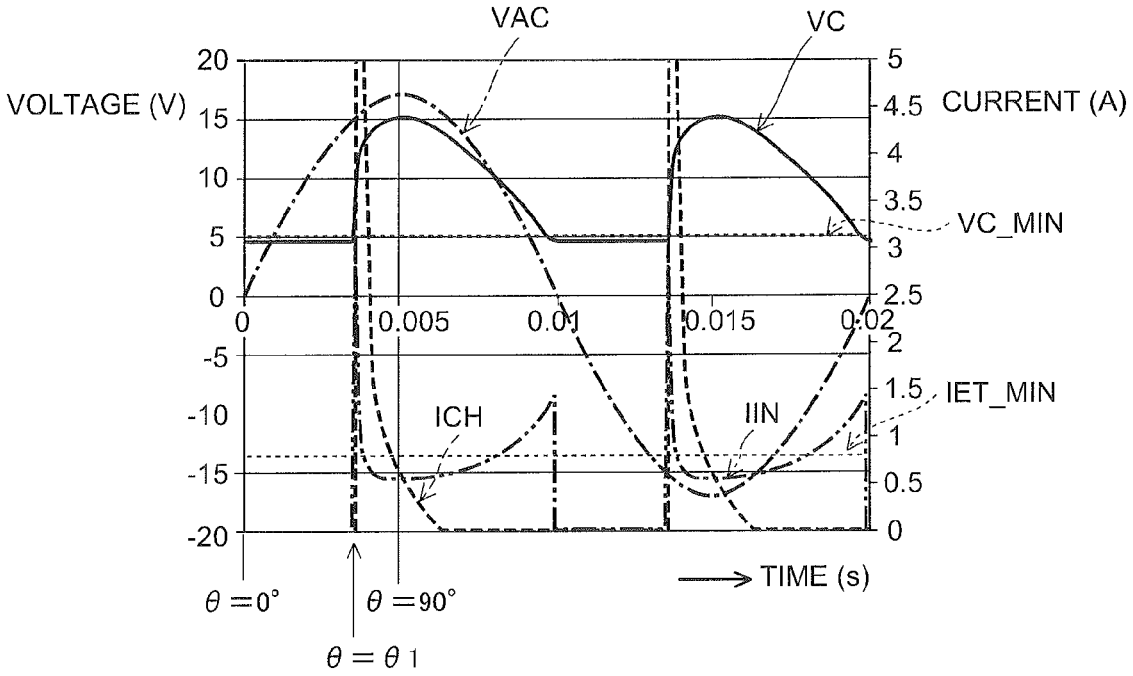

FIGS. 6A and 6B illustrate waveform diagrams exemplifying principal signals of the comparative example. FIG. 6A is a case where the dimmer is not provided, and FIG. 6B is a case where the dimmer is provided.

For reference, FIGS. 6A and 6B are waveform diagrams where the transformer 3 is not provided, and illustrates the power supply voltage VAC of the AC power supply 5, the DC voltage VC of the DC power supply circuit 12, the charging current ICH of the smoothing capacitor 18 of the DC power supply circuit 12, and the input current IIN of the switching power supply 113. In contrast, the minimum load current of the transformer 3, for example, the electronic transformer load current value at which the electronic transformer 3*a* starts the self-exciting oscillation is expressed as IET_MIN.

The operation of the comparative example 101 at the time when the power supply is turned ON is the same as that of the luminaire 1, and the power supply voltage VAC and the DC voltage VC of the comparative example in the stationary state are also the same as the luminaire 1.

When the power supply voltage VAC crosses zero at time 0 (s) and increases, the switching power supply 113 is not operated until the DC voltage VC reaches or exceeds the operable lower limit voltage VC_MIN, and the input current IIN and the charging current ICH do not flow (FIG. 6A).

When the DC voltage VC reaches or exceeds the operable lower limit voltage VC_MIN in association with the increase in the power supply voltage VAC, the input current IIN of the switching power supply 113 flows and the charging current ICH flows to the smoothing capacitor 18 slightly earlier than the input current IIN (FIG. 6A). The input current IRCT of the DC power supply circuit 12 becomes a synthetic current (IRCT=IIN+ICH) composed of the input current IIN of the switching power supply 113 and the charging current ICH of the smoothing capacitor 18.

As described above, since the switching power supply 113 controls so that the current to be supplied to the lighting load 11 becomes a constant value, if applied to the load having a highly constant voltage characteristic as the LED, an operation at the constant power is achieved as a result. Therefore, the input current (average value) IIN is inversely proportional to the change of the DC voltage VC, and an input characteristic of the switching power supply 113 is a negative resistance characteristic. The average value of the input current IIN and the driving current IDRV is characterized by decreasing when the DC voltage VC is increased, and increasing when the DC voltage VC is degreased (FIG. 6A).

Therefore, when the power supply voltage VAC increases, the input current IIN is decreased, and the proportion of the charging current ICH of the smoothing capacitor 18 in the input current IRCT (ICH/IRCT) is characterized by increasing.

As illustrated in FIG. 6B, when the trigger phase of the dimmer 4 is set to θ1, the DC voltage VC is increased abruptly and reaches or exceeds the operable lower limit voltage VC_MIN when the phase θ of the power supply voltage VAC becomes the trigger phase θ1. The peak value of the charging current ICH of the smoothing capacitor 18 increases as the trigger phase θ1 gets close to 90° (FIG. 6B). The charging current ICH is degreased abruptly after the peak.

In addition, when the DC voltage VC is increased, the input current IIN of the switching power supply 113 is decreased. Therefore, in the vicinity of the peak value at which the power supply voltage VAC becomes the maximum value or the minimum value, the proportion of the charging current ICH of the smoothing capacitor 18 in the input current IRCT (ICH/IRCT) is characterized by increasing as the trigger phase θ1 gets close to 90°.

Therefore, in the comparative example 101, the proportion that the minimum load current when the dimmer 4 and the transformer 3 need the minimum load current for the stable operation depends on the charging current to the smoothing capacitor 18 (a rush current) increases as the trigger phase θ1 gets closer to 90°. Since the charging current ICH of the smoothing capacitor 18 varies by the influence of the line impedance or the power supply variation, the operation of the dimmer 4 and the transformer 3 (the electronic transformer 3*a*) may not be stabilized.

When the transformer 3 is the self-exciting electronic transformer 3*a*, for example, the electronic transformer 3*a* stops operation immediately even though the dimmer 4 is triggered at the trigger phase θ1 if the input current IRCT is not larger than the minimum load current IET_MIN, that is, if IRCT>IET_MIN is not satisfied.

Therefore, in the comparative example, for example, the dimmer 4 may be extinguished due to the lack of the holding current, and the electronic transformer 3*a* may stop outputting. Also, a complex web of an operation in which the dimmer 4 is extinguished by the lack of the holding current and the electronic transformer 3*a* stops outputting and an operation in which the electronic transformer 3*a* stops outputting due to the lack of the load current of the electronic transformer 3*a* may occur.

In contrast, in the first embodiment, since the input current of the switching power supply is controlled to be a constant current, the proportion of the charging current of the smoothing capacitor in the input current of the DC power supply circuit is characterized by decreasing as the trigger phase of the dimmer gets close to 90°. Consequently, even when the power supply voltage varies, the decrease of the load currents of the dimmer and the transformer is restrained, and hence the dimmer and the transformer maintain its stable operation.

Also, for example, even when an electronic transformer for lighting a 12V low volt halogen lamp and the dimmer are combined, flicker does not occur and the stable lighting and dimming are achieved.

In the description given above, the configuration of the luminaire 1 in which the AC voltage VIN controlled in phase by the pair of input terminals 7 and 8 is input is exemplified as the luminaire according to the first embodiment. The configuration in which the DC power supply circuit 12 is connected to the AC power supply 5 via the transformer 3 and the dimmer 4 is exemplified. However, the luminaire may have a configuration further including at least either one of the transformer 3 and the dimmer 4.

Second Embodiment

Returning back to FIG. 1 again, a luminaire 2 according to a second embodiment includes the luminaire 1, the transformer 3 connected to the input terminals 9 and 10 of the luminaire 1, and the dimmer 4 connected to the terminal 7 of the transformer 3.

The luminaire 1, the transformer 3, and the dimmer 4 are the same as those in the first embodiment, and the same effects as those of the luminaire 1 are obtained.

Although the exemplary embodiments have been described with reference to the detailed examples, the configurations are not limited to the exemplary embodiments, and various modifications are applicable.

For example, the lighting source 14 may be the LED or the OLED, and the lighting source 14 may include a plurality of LEDs connected in series or in parallel.

Although the DC-DC converter including the switching element 21 and the current detection resistor 22 has been exemplified as the switching power supply 13, other configurations may be employed as long as the input current IIN is controlled to a constant current.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A luminaire comprising:

a DC power supply circuit configured to convert an AC voltage that is phase-controlled by a dimmer, to a DC voltage, the DC power supply circuit being connected to receive an output of an electronic transformer configured to convert a frequency of the AC voltage to a different frequency;

a switching power supply connected to the DC power supply circuit and controlled so that an input current to the switching power supply is a constant current; and a lighting load connected as a load circuit of the switching power supply;

the switching power supply including:

a switching element configured to allow the input current to flow to the switching power supply when the switching element is turned ON, and to stop the input current when the switching element is turned OFF;

a current detection resistor configured to detect a voltage proportional to the input current;

a low-pass filter configured to filter the voltage detected by the current detection resistor, and output the filtered voltage as an average value of the input current;

an error amplifying circuit including a reference voltage generating circuit, the error amplifying circuit configured to compare a reference voltage generated by the reference voltage generating circuit with the filtered voltage, amplify a differential voltage between the reference voltage and the filtered voltage, and output the amplified differential voltage as an error signal; and a pulse-width modulation (PWM) circuit configured to generate a control signal based on the error signal, and to control the switching element based on the control signal.

2. The luminaire according to claim 1, wherein the switching power supply is a converter in which the switching element is configured to allow the input current to flow to the lighting load when the switching element is turned OFF, and includes an inductor that is charged by the input current when the switching element is turned ON, and wherein the switching power supply is configured to supply the current of the charged inductor to the lighting load when the switching element is turned OFF.

3. The luminaire according to claim 1, further comprising the electronic transformer.

4. The luminaire according to claim 3, wherein the electronic transformer is a self-exciting electronic transformer.

5. The luminaire according to claim 3, wherein the electronic transformer is configured to lower the AC voltage.

6. The luminaire according to claim 1, wherein the switching power supply is configured to control the average value of the input current to be a constant current.

7. The luminaire according to claim 3, further comprising the dimmer, the dimmer being connected to the electronic transformer.

8. A luminaire comprising:

a DC power supply circuit configured to convert an output of a self-exciting electronic transformer configured to lower an AC voltage that is phase-controlled by a dimmer, to a DC voltage;

a switching power supply connected to the DC power supply circuit and controlled so that an input current to the switching power supply is a constant current; and a lighting load connected as a load circuit of the switching power supply, the switching power supply including:

a switching element configured to allow the input current to flow to the switching power supply when the switching element is turned ON, and to stop the input current when the switching element is turned OFF;

a current detection resistor configured to detect a voltage proportional to the input current;

a low-pass filter configured to filter the voltage detected by the current detection resistor, and output the filtered voltage as an average value of the input current;

an error amplifying circuit including a reference voltage generating circuit, the error amplifying circuit configured to compare a reference voltage generated by the reference voltage generating circuit with the filtered voltage, amplify a differential voltage between the reference voltage and the filtered voltage, and output the amplified differential voltage as an error signal; and a pulse-width modulation (PWM) circuit configured to generate a control signal based on the error signal, and to control the switching element based on the control signal.

9. The luminaire according to claim 8, wherein the switching power supply is a converter in which the switching element is configured to allow the input current to flow to the lighting load when the switching element is turned OFF and includes an inductor that is charged by the input current when the switching element is turned ON, and wherein the switching power supply is configured to supply the current of the charged inductor to the lighting load when the switching element is turned OFF.

10. The luminaire according to claim 8, further comprising the electronic transformer.

11. The luminaire according to claim 10, further comprising the dimmer, the dimmer being configured to control the phase of the AC voltage and output the phase-controlled AC voltage to the electronic transformer.

12. A method of controlling power supplied to a lighting load comprising:

converting a phase-controlled AC voltage to a DC voltage;

supplying the DC voltage to a switching power supply that includes a switching element;

controlling the switching element so that, when the DC voltage is above a predetermined voltage, an input current to the switching power supply is constant; and supplying power to the lighting load with the switching power supply, wherein controlling the switching element includes:

allowing the input current to flow to the switching power supply when the switching element is turned ON, and stopping the input current from flowing when the switching element is turned OFF;

detecting a voltage proportional to the input current;

filtering the detected voltage proportional to the input current;

outputting the filtered voltage as an average voltage of the input current;

comparing a reference voltage and the filtered voltage;

amplifying a differential voltage between the reference voltage and the filtered voltage;

outputting the amplified differential voltage as an error signal;

generating a control signal based on the error signal; and controlling the switching element based on the control signal.

13. The method according to claim 12, wherein the switching element is controlled in accordance with a control signal from a pulse width modulation circuit, the control signal being generated based in part on the detected voltage.

14. The method according to claim 12, wherein the switching power supply includes an inductor that is charged by the input current and supplies the current of the charged inductor to the lighting load.

15. The method according to claim 14, wherein the inductor supplies the current of the charged inductor to the lighting load during a period when the switching element is turned OFF.

16. The method according to claim 12, wherein the converting the phase-controlled AC voltage to the DC voltage includes lowering an input AC voltage and changing a frequency of the input AC voltage.

17. The method according to claim 16, further comprising:

controlling a phase of the input AC voltage la using a dimmer.

18. The luminaire according to claim 9, wherein the switching power supply further includes a rectification element configured to allow the inductor to discharge to the lighting load, the inductor, the switching element, and the current detection resistor are connected in series to the DC power supply circuit such that the voltage appears across the current detection resistor, and the lighting load is connected to both ends of the inductor via the rectification element.

* * * * *